US011209177B2

(12) United States Patent
Ito et al.

(10) Patent No.: US 11,209,177 B2
(45) Date of Patent: Dec. 28, 2021

(54) SYSTEM AND METHOD FOR CONTROLLING THE OPERATION OF AN OUTDOOR AIR CONDITIONER

(71) Applicant: Mitsubishi Electric Corporation, Tokyo (JP)

(72) Inventors: Shinichi Ito, Suwanee, GA (US); So Nomoto, Suwanee, GA (US); Daisuke Sakai, Suwanee, GA (US)

(73) Assignee: Mitsubishi Electric Corporation, Tokyo (JP)

( * ) Notice: Subject to any disclaimer, the term of this patent is extended or adjusted under 35 U.S.C. 154(b) by 1303 days.

(21) Appl. No.: 14/550,148

(22) Filed: Nov. 21, 2014

(65) Prior Publication Data

US 2016/0146498 A1 May 26, 2016

(51) Int. Cl.
*F24F 11/00* (2018.01)
*F24F 3/153* (2006.01)

(52) U.S. Cl.
CPC ..... *F24F 3/153* (2013.01)

(58) Field of Classification Search
CPC ..... F25B 2600/23; F25B 2700/15; F25B 2700/2106; F25B 2600/01; F24F 11/0079; F24F 11/0012; F24F 2221/34; G05D 23/122; G05D 23/1393
See application file for complete search history.

(56) References Cited

U.S. PATENT DOCUMENTS 7,827,813 B2 11/2010 Seem
2003/0102121 A1* 6/2003 Lee ..... F24F 1/0007 165/240
2003/0146289 A1* 8/2003 Sekhar ..... F24F 3/0442 236/49.3
2006/0186214 A1* 8/2006 Simon ..... G05D 23/1902 236/1 C
2008/0110187 A1 5/2008 Han et al.
2011/0046790 A1* 2/2011 Miller ..... F24F 11/77 700/276
2012/0228393 A1* 9/2012 Storm ..... F24F 11/0008 236/44 A
2013/0085613 A1 4/2013 Bester et al.
2013/0178987 A1* 7/2013 Meirav ..... F24F 11/0001 700/276
2014/0188286 A1* 7/2014 Hunka ..... G05D 23/19 700/276
2015/0051741 A1* 2/2015 Bruck ..... F24F 11/30 700/276
2015/0210140 A1* 7/2015 Matsuoka ..... B60H 1/00207 165/203

* cited by examiner

*Primary Examiner* — Jianying C Atkisson
*Assistant Examiner* — Meraj A Shaikh
(74) *Attorney, Agent, or Firm* — Posz Law Group, PLC

(57) ABSTRACT

A method is provided for controlling an outdoor air conditioner formed outside of a structure, the method including: drawing outdoor air into the outdoor air conditioner; cooling the outdoor air to a dehumidification temperature to provide dehumidified air in the outdoor air conditioner; determining whether an air conditioning load exists in an air conditioning space inside the structure; heating the dehumidified air to generate supply air if it is determined that no air conditioning load exists in the air conditioning space; passing the dehumidified air at the dehumidification temperature as the supply air if it is determined that an air conditioning load exists in the air conditioning space; and providing the supply air to the air conditioning space.

21 Claims, 7 Drawing Sheets

SYSTEM AND METHOD FOR CONTROLLING THE OPERATION OF AN OUTDOOR AIR CONDITIONER

FIELD OF THE INVENTION

The present invention relates generally to air conditioning systems that include an outside air conditioning unit and one or more indoor air conditioning units. More particularly, the present invention relates to a system and method for controlling the degree to which air is heated by an outdoor air conditioning unit in such a system.

BACKGROUND OF THE INVENTION

In many conventional air-conditioning systems, the system includes an outdoor air conditioning unit (OACU) and one or more indoor air conditioning units (IACUs) in one or more rooms of a structure, respectively. The outdoor air conditioning unit provides supply air at a base temperature, while the individual IACUs refine the temperature of the air in the individual rooms to achieve a desired air temperature.

In addition to heating and cooling air, many air conditioning systems also operate to remove humidity from the air they provide. This is generally done by cooling the outdoor air down to the dew point (55° F.) in the OACU, at which point moisture will condense out of the air.

Since 55° F. is typically colder than the temperature most users desire for their air, air conditioning systems that remove humidity from the air also typically have a heater such that the dehumidified air can be reheated at the OACU before it is provided to the individual rooms in the structure at the base temperature. Typically, the base temperature of supply air is approximately the desired temperature for the room or rooms. In other words, in an ideal circumstance, the OACU would perform all of the work, providing air at the desired temperature.

However, the individual rooms can often have an air conditioning load associated with them. This air conditioning load represents an amount of heating or cooling that must be performed on the supply air to bring the air in the room to the desired temperature (i.e., the temperature set by an occupant of the room). For example, if a room is full of people, that will tend to raise the temperature in that room. If the base temperature of the supply air is approximately the desired temperature, then the people in the room will raise the room's temperature, requiring an associated IACU to cool the air. Likewise, if the temperature outside the room, or outside the structure, is significantly different than the desired temperature in the room, this may cause the temperature in the room to move away from the base temperature of the supply air, again requiring an IACU to heat or cool the air so that it can reach the desired temperature.

In situations in which the air is dehumidified and the air conditioning load in a room requires an IACU to cool the air, this may result in the OACU heating the air, while one or more IACUs cool the air. This is a waste of energy, since the OACU and the IACU are working at cross purposes.

It would therefore be desirable to have an air conditioning system in which the heating of air by an OACU was regulated so as to minimize the total power expended by the OACU and any associated IACUs.

SUMMARY

A method of controlling an outdoor air conditioner provided outside of a structure, the method including: drawing outdoor air into the outdoor air conditioner; cooling the outdoor air to a dehumidification temperature to provide dehumidified air in the outdoor air conditioner; determining whether an air conditioning load exists in an air conditioning space inside the structure; heating the dehumidified air to generate supply air if no air conditioning load is determined to exist in the air conditioning space; passing the dehumidified air at the dehumidification temperature as the supply air if an air conditioning load is determined to exist in the air conditioning space; and providing the supply air to the air conditioning space.

In one embodiment, a minimum on time is a minimum amount of time that the dehumidified air can be heated; a minimum off time is a minimum amount of time that the dehumidified air can be passed as supply air without being heated, and the minimum on time is greater than the minimum off time.

The method may further include: determining whether the dehumidified air is currently being heated; determining whether the dehumidified air has been heated for a minimum on time if it is determined that the dehumidified air is currently being heated, heating the dehumidified air to generate supply air if it is determined that the set number of the plurality of indoor air conditioners are not operating in the cooling mode, or if the dehumidified air is currently being heating, but has not been heating for at least the minimum on time; and passing the dehumidified air at the dehumidification temperature as the supply air if it is determined that all of the plurality of indoor air conditioners are operating in the cooling mode, and that either the dehumidified air is not currently being heated or that the dehumidified air has been heated for a minimum on time, wherein the minimum on time is a minimum amount of time that the dehumidified air can be heated, a minimum off time is a minimum amount of time that the dehumidified air can be passed as supply air without being heated, and the minimum on time is greater than the minimum off time.

An air conditioning system is provided, including: an outdoor air conditioner provided outside a structure, including an outdoor heat-exchanger, an outdoor heater, and an outdoor blower configured to draw outside air through the outdoor heat-exchanging coil and the outdoor heater to generate supply air, and to provide the supply air to an air conditioning space inside the structure; an indoor air conditioner provided inside the air conditioning space, including an indoor heat-exchanger, and an indoor blower configured to draw indoor air through the indoor heat-exchanging coil to generate conditioned indoor air, and to provide the conditioned indoor air to the air conditioning space; and a control circuit configured to determine whether an air conditioning load exists in the air conditioning space, and to selectively turn on the outdoor heater based on whether the air conditioning load is determined to exist in the air conditioning space.

The control circuit may further include an indoor air conditioner operation sensor configured to determine whether the indoor air conditioner is currently operating, and the air conditioning load exists if the indoor air conditioner operation sensor determines that the indoor air conditioner is currently operating in cooling mode.

The control circuit may further include a solar radiation sensor configured to detect an amount of solar radiation incident on the air conditioning space, and the air conditioning load exists if the detected amount of solar radiation exceeds a solar radiation threshold.

The control circuit may further include an indoor temperature sensor configured to detect an indoor temperature in the air conditioning space, and the air conditioning load exists if the detected indoor temperature exceeds an indoor temperature threshold.

The control circuit may further include an air conditioning space population sensor configured to detect a number of people in the room, and the air conditioning load exists if the detected number of people exceeds a population threshold.

The control circuit may further include an energy consumption sensor configured to detect an energy consumption of the air conditioning system, and the air conditioning load exists if the detected energy consumption exceeds an energy consumption threshold.

The control circuit may further include a clock configured to determine a current time of day, and the air conditioning load exists if the current time of day falls within a set time range.

The control circuit may further include a calendar circuit configured to determine a current date, and the air conditioning load exists if the current date falls within a set date range.

The control circuit may further include an outside temperature sensor configured to detect the outside temperature, the air conditioning load exists if the outside temperature is above a temperature threshold.

The control circuit may further include an indoor temperature sensor configured to detect an indoor temperature in the room, and a supply air temperature sensor configured to detect a supply air temperature of the supply air, and the air conditioning load exists if the supply air temperature is lower than the indoor temperature.

A method of controlling an outdoor air conditioner formed outside of a structure is provided, the method including: drawing outdoor air into the outdoor air conditioner; cooling the outdoor air to a dehumidification temperature to provide dehumidified air in the outdoor air conditioner; determining whether a set number of a plurality of indoor air conditioners associated in the structure, respectively, are operating; heating the dehumidified air to generate supply air if it is determined that the set number of the plurality of indoor air conditioners are not operating in the cooling mode; passing the dehumidified air at the dehumidification temperature as the supply air if it is determined that all of the plurality of indoor air conditioners are operating in the cooling mode; and providing the supply air to the plurality of air conditioning spaces.

The method may further include: continually repeating the operations of drawing outside air, cooling the outside air, determining whether the plurality of indoor air conditioners are operating, passing the dehumidified air as the supply air if it is determined that the set number of the plurality of indoor air conditioners are operating in the cooling mode, and providing the supply air to the air conditioning space.

The set number of the plurality of indoor air conditioners may be all of the plurality of indoor air conditioners.

The method may further include: determining whether the plurality of indoor air conditioners are operating and heating the dehumidified air if it is determined that the set number of the plurality of indoor air conditioners are not operating in the cooling mode.

The method may further include comprising: heating the dehumidified air if it is determined that one of the plurality of indoor air conditioners are operating in the heating mode.

In one embodiment, a minimum on time is a minimum amount of time that the dehumidified air can be heated, a minimum off time is a minimum amount of time that the dehumidified air can be passed as supply air without being heated, and the minimum on time is greater than the minimum off time.

The method may further include: determining whether the dehumidified air is currently being heated; determining whether the dehumidified air has been heated for a minimum on time if it is determined that the dehumidified air is currently being heated, heating the dehumidified air to generate supply air if it is determined that the set number of the plurality of indoor air conditioners are not operating in the cooling mode, or if the dehumidified air is currently being heating, but has not been heating for at least the minimum on time; and passing the dehumidified air at the dehumidification temperature as the supply air if it is determined that all of the plurality of indoor air conditioners are operating in the cooling mode, and that either the dehumidified air is not currently being heated or that the dehumidified air has been heated for a minimum on time, wherein the minimum on time is a minimum amount of time that the dehumidified air can be heated, a minimum off time is a minimum amount of time that the dehumidified air can be passed as supply air without being heated, and the minimum on time is greater than the minimum off time.

BRIEF DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the present invention.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. Likewise, the use of positional terms such as front, back, side, top, and bottom are used solely to provide a reference point for one particular orientation, and to enhance clarity. Their use does not imply that such an orientation is required. In operation, the disclosed air handling units can be used in any desired orientation.

Air Conditioning System

Figure 1:
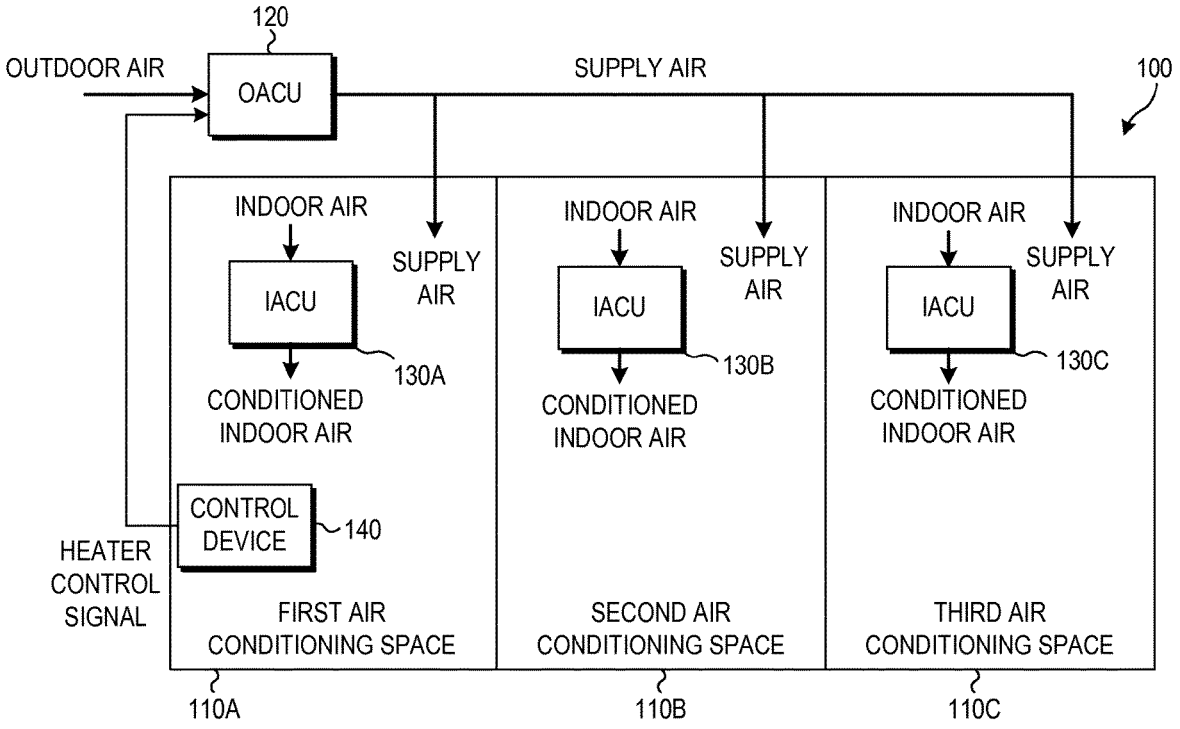
FIG. 1 is a block diagram of an air conditioning system according to a disclosed embodiment.

FIG. 1 is a block diagram of an air conditioning system 100 according to a disclosed embodiment. As shown in FIG. 1, the air-conditioning system 100 includes a plurality of air-conditioning spaces 110A-110C, an outdoor air conditioning unit (OACU) 120, a plurality of indoor air conditioning units (IACU) 130A-130C, each associated with a respective air-conditioning space 110A-110C, and a control device 140.

The plurality of air-conditioning spaces 110A-110C are all indoor spaces that need to be cooled or heated with respect to an outdoor temperature $T_O$. Each air-conditioning space 110A-110C must be heated to a respective desired target temperature $T_{T-A}$, $T_{T-B}$, $T_{T-C}$. These can be the same target temperature or different target temperatures in various embodiments. For simplicity of disclosure, the desired target temperatures $T_{T-A}$, $T_{T-B}$, $T_{T-C}$ will be collectively referred to as the desired target temperatures $T_T$, or the desired target temperature $T_T$. It should be understood that when the disclosure refers to a target temperature $T_T$, this is the target temperature for an individual air-conditioning area, and that the target temperatures $T_T$ for different air-conditioning areas may vary in some embodiments.

The air-conditioning spaces 110A-110C can be individual rooms in a structure, groups of rooms in the structure, or any indoor space that needs to have its temperature controlled. For simplicity of disclosure, the plurality of air-conditioning spaces 110A-110C will be collectively referred to as air-conditioning spaces 110, or just an air conditioning space 110. Furthermore, although FIG. 1 discloses three air-conditioning spaces 110, this is by way of example only. Alternate embodiments could have more or fewer air-conditioning spaces 110, as needed.

The OACU 120 operates to take outside air at an outside temperature $T_O$, and condition it to form supply air at a supply air temperature $T_S$, which is provided to each of the air-conditioning spaces 110. The OACU 120 can either heat or cool the outdoor air, as required to gain a desired target temperature $T_T$ in each of the air-conditioning spaces 110. In particular, the OACU 120 includes both a heat exchanger that can both heat or cool the outside air, and a heater that can heat air conditioned by the heat exchanger.

The plurality of IACUs 130A-130C are each associated with a respective air-conditioning space 110A-110C. for ease of disclosure, the plurality of IACUs 130A-130C will be referred to generically as an IACU 130, or IACUs 130.

Each IACU 130 operates to maintain its corresponding air-conditioning space 110 at a desired target temperature $T_T$. Ideally, the supply air provided by the OACU 120 will maintain each air-conditioning space 110 at its desired target temperature $T_T$. However, in many circumstances this will not be the case. This is particularly true if each air-conditioning space 110 is set to a different desired target temperature $T_T$. In such circumstances, the IACU 130 in a given air-conditioning space 110 will condition the indoor air into conditioned indoor air that will operate to maintain the air-conditioning space 110 at its desired target temperature $T_T$.

In particular, if the supply air temperature $T_S$ is below what is required to maintain the desired target temperature $T_T$ for a given air-conditioning space 110 (i.e., the supply air is too cold), the IACU 130 will heat the indoor air to provide conditioned indoor air that is warm enough to maintain the desired target temperature $T_T$ for the air-conditioning space 110. Likewise, if the supply air temperature $T_S$ is above what is required to maintain the desired target temperature $T_T$ for a given air-conditioning space 110 (i.e. the supply air is too warm), the IACU 130 will cool the indoor air to provide conditioned indoor air that is cool enough to maintain the desired target temperature $T_T$ for the air-conditioning space 110.

The control device 140 determines whether an air conditioning load exists within each of the air-conditioning spaces 110, and uses this information to control the operation of the heater in the OACU 120, as set forth below. In some embodiments, the control device 140 may also control the general operation of the OACU 120 and the IACUs 130.

Although in FIG. 1, the control device 140 is shown as being in the first air-conditioning space, portions of the control device 140 would also be present in the second air-conditioning space and the third air-conditioning space. In particular, certain sensors connected to the control device 140 would be present in each air-conditioning space.

In the embodiment of FIG. 1, the desired target temperature $T_T$ for each air-conditioning space is set at the control device. In embodiments in which a different target temperature $T_T$ is allowed for each air-conditioning space, these different target temperatures $T_T$ can be set at a central control device 140 or at individual connected control devices 140 in each air-conditioning space 110.

Outside Air Conditioning Unit

Figure 2:
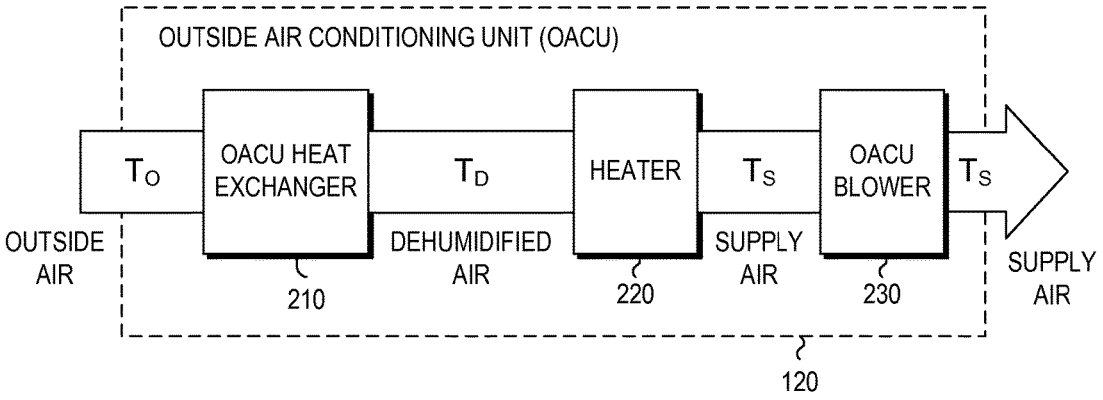
FIG. 2 is a block diagram of the outside air conditioning unit of FIG. 1 according to a disclosed embodiment.

FIG. 2 is a block diagram of the outside air conditioning unit (OACU) 120 of FIG. 1 according to a disclosed embodiment. As shown in FIG. 2, the OACU 120, acting as an outside air conditioner, includes an OACU heat exchanger 210, a heater 220, and an OACU blower 230.

The OACU heat exchanger 210 receives outside air at an outside air temperature $T_O$, and heats it or cools it, as needed. In some situations, the outside air will be both hot and humid, requiring the OACU heat exchanger 210 to first cool the air to a dehumidified temperature $T_D$, generating dehumidified air in order to remove moisture from the air being processed. In the disclosed embodiment, the dehumidification temperature $T_D$ is 55° F. However any temperature at which water condenses out of air is suitable as a dehumidification temperature.

In the disclosed embodiment, the OACU heat exchanger 210 is a heat-exchanging coil. However, alternate embodiments could employ any element capable of heating and cooling air as an OACU heat exchanger 210.

The heater 220 operates to heat the dehumidified air to an air supply temperature $T_S$. This air supply temperature $T_S$ is the temperature of the supply air that is supplied to the room or rooms in the structure to which the OACU is attached. This supply temperature $T_S$ is controlled by the control module 140, and is varied between the dehumidification temperature $T_D$ and a maximum temperature based on how much the dehumidified air is heated by the heater 220.

The heater 220 may not have to operate in some situations. For example the heater will not operate when the dehumidified air is passed directly as supply air. In this case, the heater can be turned off for as long as the dehumidified air is being passed as supply air.

The OACU blower 230 operates to draw air through the OACU heat exchanger 210 and the heater 220, and to provide conditioned air to the room or rooms in the structure associated with the OACU 120. In the disclosed embodiment, the OACU blower 230 is located after the heater 220 in the airflow through the OACU 120. Thus, the OACU draws air through the OACU heat exchanger 210 to the heater 220, and through the OACU blower 230, and then to the room or rooms in the structure.

Although FIG. 2 shows the OACU blower 230 as being located after the heater 220 in the airflow of the OACU 120, this is by way of example only. The OACU blower 230 can be located at any part along the passage of the air through the OACU 120. For example the OACU blower 230 could be located between the OACU heat exchanger 210 and the heater 220. In this case, it would pass the dehumidified air from the OACU heat exchanger 210 to the heater 220. Likewise, the OACU blower 230 could be located before the OACU heat exchanger 210. In this case, it would pass outside air from outside of the OACU 120 to the OACU heat exchanger 210.

Inside Air Conditioning Unit

Figure 3:
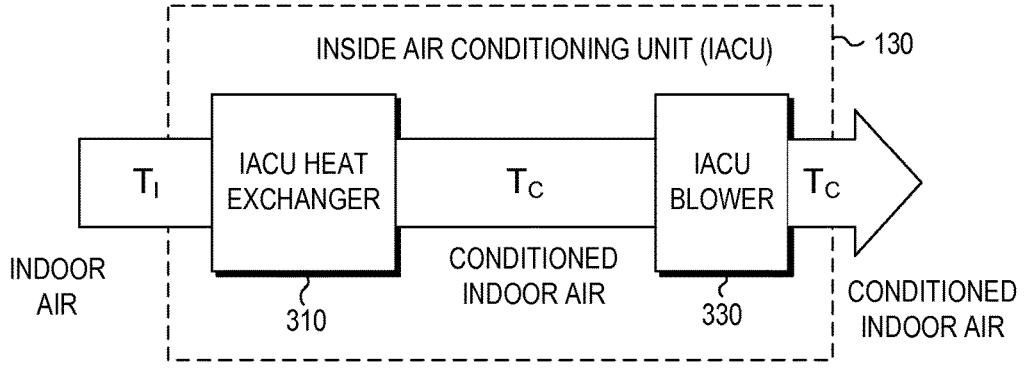
FIG. 3 is a block diagram of an inside air conditioning unit of FIG. 1 according to a disclosed embodiment.

FIG. 3 is a block diagram of an inside air conditioning unit (IACU) 130 of FIG. 1 according to a disclosed embodiment. As shown in FIG. 3, the IACU 130, acting as an indoor air conditioner, includes an IACU heat exchanger 310 and an IACU blower 330.

Each IACU 130 operates to adjust the temperature of the air in a given room of the structure associated with the OACU 120. As noted above, the OACU 120 will provide supply air at an air supply temperature $T_S$. Ideally, the supply air temperature $T_S$ will be the exact temperature required for a given room. However, if this is not the case, the IACU 130 associated with that room will operate to raise or lower the temperature of the air in that room until it is at a temperature that will maintain the desired target temperature $T_T$ for the room.

The IACU heat exchanger 310 receives indoor air from inside an air conditioning space 110, and either heats or cools this indoor air to a conditioned temperature $T_C$ to generate conditioned indoor air. The conditioned temperature $T_C$ is set to maintain the room at the desired target temperature $T_T$.

In the disclosed embodiment, the IACU heat exchanger 310 is a heat-exchanging coil. However, alternate embodiments could employ any element capable of heating and cooling air as an IACU heat exchanger 310.

The IACU blower 330 operates to draw air through the IACU heat exchanger 310, and to provide conditioned air to the room in the structure associated with the IACU 130. In the disclosed embodiment, the IACU blower 330 is located after the IACU heat exchanger 310 in the airflow through the IACU 130. Thus, the IACU 130 draws air through the IACU heat exchanger 310, through the IACU blower 330, and then to the room.

Although FIG. 3 shows the IACU blower 330 as being located after the IACU heat exchanger 310 in the airflow of the IACU 130, this is by way of example only. The IACU blower 330 can be located either before or after the IACU heat exchanger 310.

Control Module

Figure 4:
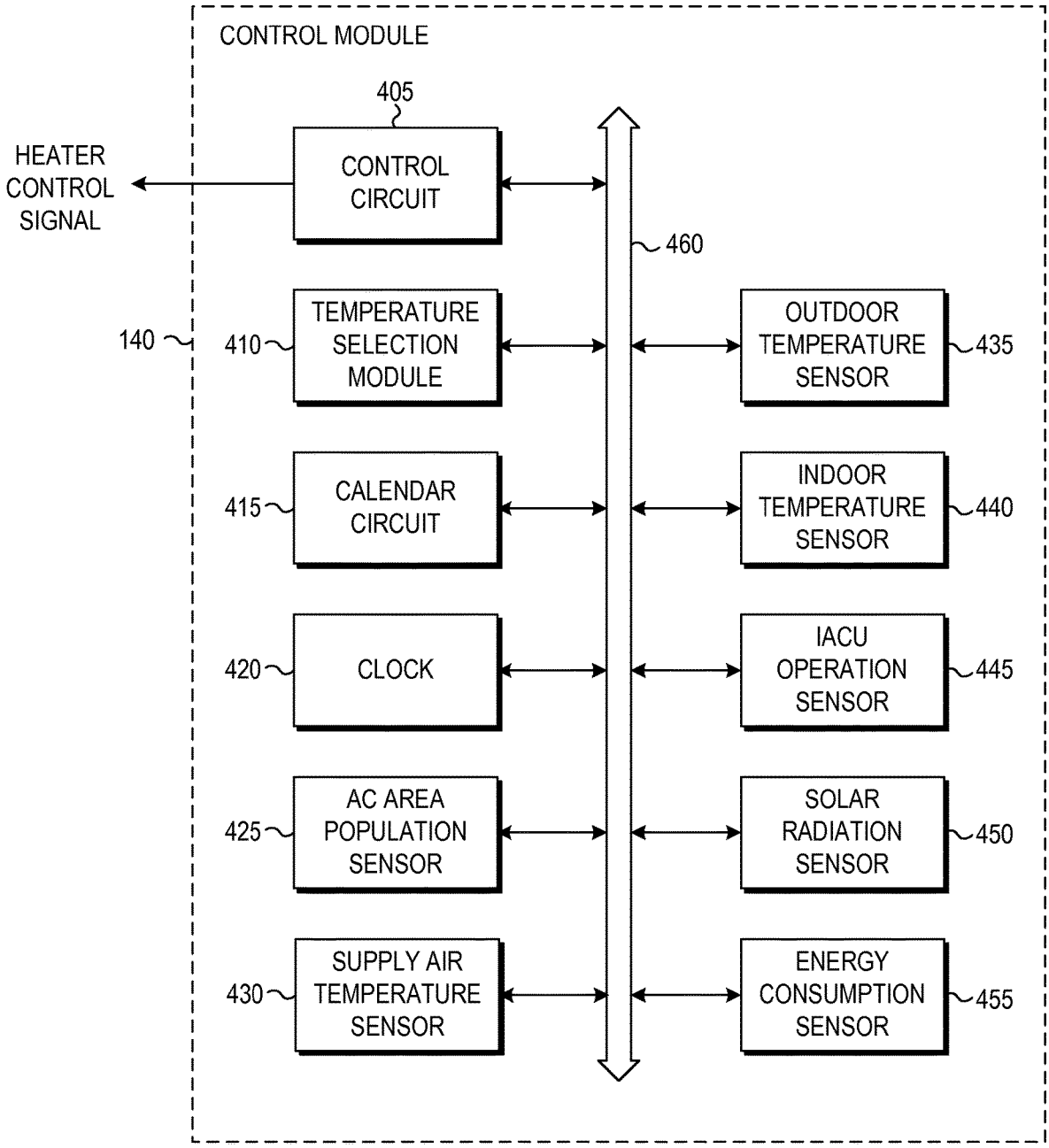
FIG. 4 is a block diagram of the control module of FIG. 1 according to a disclosed embodiment.

FIG. 4 is a block diagram of the control module 140 of FIG. 1 according to a disclosed embodiment. As shown in FIG. 4, the control module 140 includes a control circuit 405, a temperature selection module 410, a calendar circuit 415, a clock 420, an air conditioning area population sensor 425, a supply air temperature sensor 430, an outdoor temperature sensor 435, an indoor temperature sensor 440, an IACU operation sensor 445, a solar radiation sensor 450, an energy consumption sensor 455, and a bus 460.

The control circuit 405 controls at least certain aspects of the operation of the OACU 120 and may control some aspects of the operation of the IACUs 130. In particular, the control circuit 405 generates a heater control signal that controls the operation of the heater 220 in the OACU 120. The heater control signal tells the heater 220 when to turn on and when to turn off.

The control circuit 405 generates the heater control signal based on information received from the temperature selection module 410, the calendar circuit 415, the clock 420, the air conditioning area population sensor 425, the supply air temperature sensor 430, the outdoor temperature sensor 435, the indoor temperature sensor 440, the IACU operation sensor 445, the solar radiation sensor 450, and the energy consumption sensor 455.

The temperature selection module 410 sets a target temperature $T_T$ for each air conditioning area 110 in the structure associated with the OACU 120, and provides the target temperature $T_T$ to the control circuit 405 via the bus 460. Typically, these target temperatures $T_T$ are set by a resident of the air conditioning area 110, though in some embodiments they can be set by an administrator.

In some embodiments, the temperature selection module 410 will set the same temperature for all of the air conditioning areas 110 in the structure; in other embodiments, the temperature selection module 410 can select a different temperature for each air conditioning area 110. Furthermore, in some embodiments the target temperature $T_T$ for each air conditioning area 110 will be set at a central location, e.g., the control module 140. However, alternate embodiments can allow the target temperature $T_T$ for each air conditioning area 110 to be set via a thermostat located in each corresponding air conditioning area 110. In this case, each of the thermostats will connect to the temperature selection module 410 to identify the target temperature $T_T$ for that air conditioning area 110.

The calendar circuit 415 monitors the current date, and provides that date to the control circuit 405 via the bus 460.

The clock 420 monitors the current time, and provides that time to the control circuit 405 via the bus 460.

The air conditioning area population sensor 425 detects an actual or approximate number of people in one or more air conditioning areas 110 of the structure, and provides that value to the control circuit 405 via the bus 460. Since it is necessary to perform detection operations in each air conditioning area 110, a portion of the room population sensor 425 will be located in each air conditioning area 110. Once the population numbers have been determined, each air conditioning area 110 will communicate with the portion of the air conditioning area population sensor 425 located in the control module 140.

The supply air temperature sensor 430 detects the actual supply temperature $T_S$ of the supply air provided by the OACU 122 each of the air conditioning areas 110 in the structure associated with the OACU 120. The supply air temperature sensor 430 provides this value of the actual supply temperature $T_S$ to the control circuit 405 via the bus 460.

The outdoor temperature sensor 435 detects the outdoor temperature $T_O$ of the air outside the structure to which the OACU 120 is attached, and communicates that outdoor temperature value to the control circuit 405 via the bus 460.

The indoor temperature sensor 440 detects the actual indoor temperature $T_I$ in each of the air conditioning areas 110 in the structure, and provides these indoor temperature values to the control circuit 405 via the bus 460. These actual indoor temperatures $T_I$ can be compared with the desired target temperatures $T_T$ for the air conditioning areas 110 to help the control circuit 405 generate the heater control signal.

The IACU operation sensor 445 detects whether any of the IACUs 130 are in operation, i.e., heating or cooling their respective air conditioning areas 110, and if so which of the IACUs 130 are in operation. This can serve as an indication as to whether there is an air conditioning load in a given air conditioning area 110. The IACU operation sensor 445 provides the information regarding which, if any, IACUs 130 are in operation to the control circuit 405 via the bus 460.

The solar radiation sensor 450 operates to detect an amount of solar radiation incident upon the structure to which the OACU 120 is connected, or incident upon a particular air conditioning area 110 within the structure. Solar radiation is an indirect measurement of the air conditioning load imposed on the room or rooms in the structure by the heat of the sun. The solar radiation sensor 450 provides the detected amount of solar radiation to the control circuit 405 via the bus 460.

The energy consumption sensor 455 operates to detect the energy consumption of the OACU 120, and all IACUs 130 associated with the OACU 120. In this way, the energy consumption sensor 455 can detect the energy consumption for the entire air-conditioning system 100. The energy consumption sensor 455 provides the total energy consumption value to the control circuit 405 via the bus 460.

The bus 460 is connected to the other elements of the control module 140, and serves to facilitate communication between these elements. In particular it allows the temperature selection module 410, the calendar circuit 415, the clock 420, the air conditioning area population sensor 425, the supply air temperature sensor 430, the outdoor temperature sensor 435, the indoor temperature sensor 440, the IACU operation sensor 445, the solar radiation sensor 450, and the energy consumption sensor 455 to provide data to the control circuit 405.

Although a bus 460 is shown connecting the various elements of the control module 140, this is by way of example only. Alternate embodiments could have the various elements of the control module 140 directly connected to the control circuit 405. Other embodiments could have some sensors connected to the control circuit 405 via the bus 460, and others directly connected to the control circuit 405.

In addition, although the control module 140 of FIG. 4 shows a cooling multiple sensors, alternate embodiments could have more or fewer sensors. Such embodiments may use more or less information to generate a heater control signal.

Air Conditioning Loads

In a cooling operation on hot and humid air, the OACU 120 draws in the outdoor air at an outdoor temperature $T_O$, cools the outdoor air down to a dehumidification temperature $T_D$ in order to remove moisture from it, and then heats the dehumidified air up to a supply air temperature $T_S$, at which point the air is provided to the air-conditioning spaces 110 of the structure associated with the OACU 120 as supply air.

Once the supply air is supplied to an air-conditioning space 110, it must then overcome an air conditioning load in that air-conditioning space 110 in order to keep the air-conditioning space 110 at a desired target temperature $T_T$. The air conditioning load in the air-conditioning space 110 represents something that will keep the air-conditioning space 110 away from its desired target temperature $T_T$, and so will require additional energy to move the temperature of the air back to the desired target temperature $T_T$. If the air-conditioning space 110 is being cooled, for example, the air conditioning load in that air-conditioning space 110 would be caused by anything that would tend to warm the air-conditioning space 110 below its desired target temperature $T_T$. Some examples of this are having a large number of people in the air-conditioning space 110, whose body heat can raise the temperature of the air-conditioning space 110, having a high outdoor temperature, which can warm the structure in general, making it more difficult to keep the air-conditioning space 110 cool, or having a large amount of sunlight (i.e., solar radiation) incident on the structure, which can warm the structure, again making it more difficult to keep the air-conditioning space 110 cool.

Consider an example in which the supply air temperature $T_S$ was 72° F., and the desired target temperature $T_T$ for an air-conditioning space 110 was also 72° F. If it was a moderate day, with little sunlight incident on the structure, and no one was in the air-conditioning space 110, there might be little or no air conditioning load in the air-conditioning space 110. In such case, the supply air would be sufficient to keep the air-conditioning space 110 at the desired target temperature $T_T$, and the IACU 130 associated with the air-conditioning space 110 could remain off.

However, if it was a very warm day, with a large amount of sunlight incident on the structure, and a large number of people in the air-conditioning space 110, there would be a number of heat sources that could tend to raise the temperature in the air-conditioning space 110. In such case, the 72° F. supply air would be warmed by the various sources of heat, making the actual temperature of the air-conditioning space 110 higher than 72° F. In order to keep the temperature at its desired target temperature $T_T$, the IACU 130 associated with the air-conditioning space 110 would have to turn on in order to cool the air in the room to the desired target temperature $T_T$.

Figure 5:
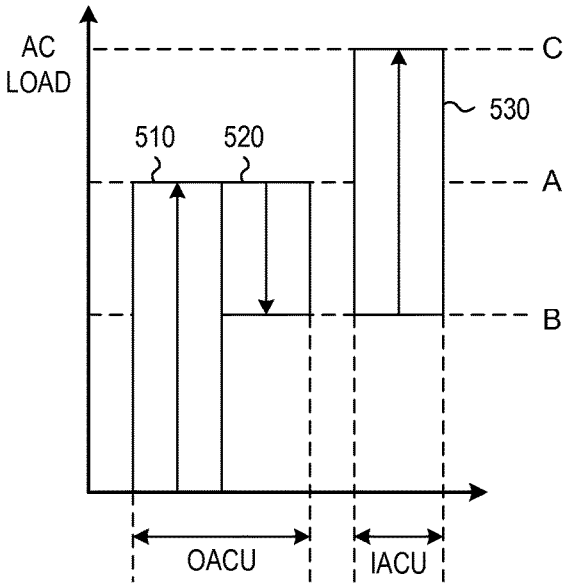
FIG. 5 is a graph of the load of the outside air conditioning unit and the inside air conditioning unit of FIG. 1 according to a disclosed embodiment.

FIG. 5 is a graph of the load of the outside air conditioning unit (OACU) 120 and an inside air conditioning unit (IACU) 130 of FIG. 1 according to a disclosed embodiment. In this embodiment the outside air is warm and humid, requiring dehumidification, and there is an air conditioning load in the air-conditioning space 110 associated with the IACU 130. For the sake of simplicity, this graph will consider the case of controlling the temperature in a single air-conditioning space 110 with a single IACU 130 in the structure associated with the OACU 120. However, it can easily be extended to address the total load in multiple air-conditioning spaces 110 in a structure.

As shown in FIG. 5, the OACU 120 has a first cooling air conditioning load 510 and a first heating air conditioning load 520, while the IACU 130 has a second cooling air conditioning load 530. In this graph, loads with an arrow pointing up represent cooling air conditioning loads, while loads with an arrow pointing down represent heating air conditioning loads.

The first cooling air conditioning load 510 represents the energy A required for the OACU 120 to cool outdoor air from an outdoor temperature $T_O$ to a dehumidified temperature $T_D$.

The first heating air conditioning load 520 represents the energy (A–B) required for the OACU 120 to heat the dehumidified air from the dehumidified temperature $T_D$ to a supply air temperature $T_S$ that is close to the desired target temperature $T_T$ of the air-conditioning space 110.

The second cooling air conditioning load 530 represents the energy (C–B) required for the IACU 130 to overcome the air conditioning load in the air-conditioning space 110 associated with the IACU 130.

The total amount of energy expended by the OACU 120 and the IACU 130 is represented by the total volume of the first and second cooling loads 510, 530 and the first heating load 520, i.e., A+(A–B)+(C–B)=C+2(A–B). As shown in FIG. 5, however, energy (A–B) is being expended twice, once to heat the air after being dehumidified and once to cool the air after it is heated. This is wasted energy, which should be minimized. Ideally, the dehumidified air should only be heated as much as necessary to obtain a desired target temperature $T_T$ in the air-conditioning space 110.

Figure 6:
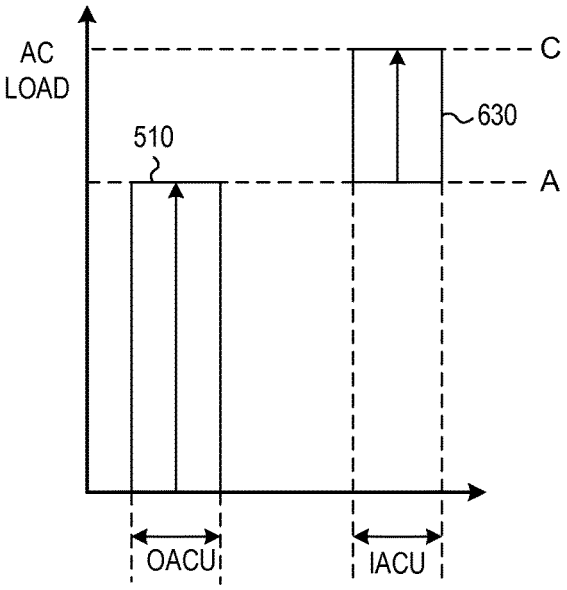
FIG. 6 is a graph of the load of the outside air conditioning unit and the inside air conditioning unit of FIG. 1 according to another disclosed embodiment.

FIG. 6 is a graph of the load of the outside air conditioning unit (OACU) 120 and an inside air conditioning unit (IACU) 130 of FIG. 1 according to another disclosed embodiment. In this embodiment the outside air is warm and humid, requiring dehumidification, and there is an air conditioning load in the air-conditioning space 110 associated with the IACU 130. As with FIG. 5, for the sake of simplicity, this graph will consider the case of controlling the temperature in a single air-conditioning space 110 with a single IACU 130 in the structure associated with the OACU 120. However, it can easily be extended to address the total load in multiple air-conditioning spaces 110 in a structure.

As shown in FIG. 6, the OACU 120 has a first cooling air conditioning load 510, while the IACU 130 has a third cooling air conditioning load 630. As with FIG. 5, loads with an arrow pointing up represent cooling air conditioning loads. The embodiment of FIG. 6 has no heating load, meaning that the dehumidified air is not heated at all, but is provided as the supply air.

As in FIG. 5, the first cooling air conditioning load 510 represents the energy A required for the OACU 120 to cool outdoor air from an outdoor temperature $T_O$ to a dehumidified temperature $T_D$. This dehumidified air at the dehumidified temperature $T_D$ is provided directly to the air-conditioning space 110 as supply air. In other words, the supply air temperature $T_S$ is equal to the dehumidified temperature $T_D$.

In this embodiment, however, the temperature required to maintain the air-conditioning space 110 at a desired target temperature $T_T$ is lower than the dehumidification temperature $T_D$. As a result, the IACU 130 must operate to further cool the indoor air to maintain the desired target temperature $T_T$.

The third cooling air conditioning load 630 represents the energy (C–A) required for the IACU 130 to cool the indoor air to keep it at the desired target temperature $T_T$.

In this embodiment, the air conditioning load of the air-conditioning space 110 is sufficiently high that even if the supply air is provided at the dehumidified temperature $T_D$, it is still not sufficiently cold to maintain the air-conditioning space 110 at the desired target temperature $T_T$. Therefore, the IACU 130 must further cool the air to keep it at the desired target temperature $T_T$.

Consider, for example, if the dehumidified temperature $T_D$ is 55° F., and the desired target temperature $T_T$ is 72° F. In this example, the air conditioning load in the air-conditioning space 110 is sufficiently high that even if supply air is provided to the air-conditioning space 110 at 55° F., the sources of heat operating on the air-conditioning space 110 are sufficient that the temperature of the air-conditioning space 110 will be above 72° F. As a result, the IACU 130 must operate to further cool the air in the air-conditioning space 110 to keep it at 72° F.

The total amount of energy expended by the OACU 120 and the IACU 130 is represented by the total volume of the first and third cooling loads 510, 630, i.e., A+(C–A)=C. As shown in FIG. 6, no energy is lost in needlessly heating the dehumidified air, since the air conditioning load in the air-conditioning space 110 is so high that even supply air at the dehumidified temperature $T_D$ will not keep the air-conditioning space 110 at its desired target temperature $T_T$. However, in this embodiment the air-conditioning system 100 expends the minimum amount of energy to cool the supply air to a desired target temperature $T_T$.

Operation of the Air Conditioning System

Figure 7:
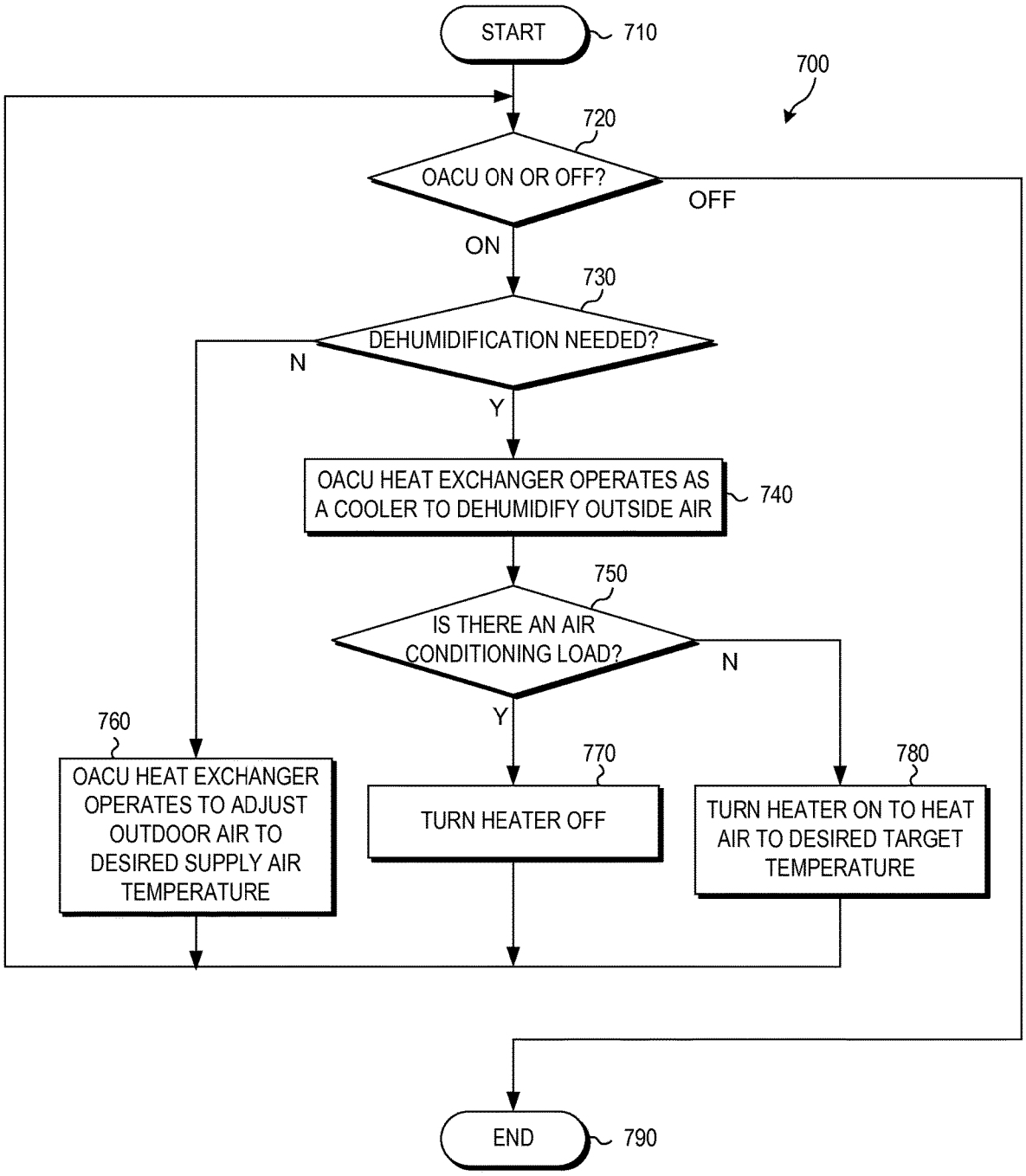
FIG. 7 is a flow chart of the operation of the air conditioning system of FIG. 1 according to a disclosed embodiment.

FIG. 7 is a flow chart of the operation of the air conditioning system of FIG. 1 according to a disclosed embodiment.

As shown in FIG. 7 once the operation starts (710) a controller (e.g., the control module 140) determines whether or not an OACU 120 is on or off (720). In other words, it determines whether the OACU 120 is operating to condition outdoor air into supply air to be provided to a plurality of air-conditioning spaces 110.

If it is determined that the OACU 120 is off, then processing ends (790). However, if the OACU 120 is on, the controller determines whether dehumidification is needed (730). In other words, the controller determines whether the outside air is humid enough that it must have moisture removed from it before it is provided as supply air.

If no dehumidification is required, then the OACU 120 operates to adjust outdoor air to a desired supply air temperature (760), which can be provided to one or more air-conditioning spaces 110. Processing then returns to a determination of whether the OACU 120 is on or off (720).

If dehumidification is required, then the OACU 120 operates first as a cooler to dehumidify the outside air (740). In particular, the OACU heat exchanger 210 cools the outdoor air from an outdoor temperature $T_O$ to a dehumidified temperature $T_D$ to remove moisture from the outside air and to form dehumidified air.

After the OACU 120 cools the outdoor air into dehumidified air, the controller determines if there is a cooling air conditioning load in an air-conditioning space 110 to which the supply air will be supplied (750). In other words, the controller determines whether there is any reason that an IACU 130 would have to further cool indoor air in the air-conditioning space 110 if the supply air temperature $T_S$ were greater than the dehumidified temperature $T_D$.

If it is determined that there is a cooling air conditioning load in the air-conditioning space 110, then the controller will turn off the heater 220 in the OACU 120 for a time (770). When it does this, the OACU 120 will provide supply air to the air-conditioning space 110 at a supply temperature $T_S$ that is equal to the dehumidified temperature $T_D$. In other words, it will provide supply air that is cooler than the desired target temperature $T_T$ in an effort to overcome some of the cooling air conditioning load.

After the heater is turned off, processing then returns to a determination of whether the OACU 120 is on or off (720).

If, however, it is determined that there is no cooling air conditioning load, then the controller turns on the heater 220 in the OACU 120 for a time to heat the dehumidified air into supply air having a supply temperature $T_S$ that approaches a temperature sufficient to maintain the desired target temperature $T_T$.

After the heater is turned off, processing then returns to a determination of whether the OACU 120 is on or off (720).

In this way, the heater 220 and the OACU 120 are only operated when it would not cause an IACU 130 to have to cool air that has been heated by the OACU 120. Ideally, this would either cause the supply air temperature $T_S$ to be heated to exactly what was needed to maintain the desired target temperature $T_T$ of the air-conditioning area 110, or cause the supply air temperature $T_S$ to be higher than what is needed to maintain the desired target temperature $T_T$.

The determination of cooling air conditioning loads becomes more difficult when an OACU 120 is connected to multiple air-conditioning areas 110, which may have different desired target temperatures $T_T$, and different cooling air conditioning loads. For example, if a first air-conditioning area 110A has a desired target temperature $T_T$ of 70° and a second air-conditioning area 110B has a desired target temperature $T_T$ of 75°, it is possible that the first air-conditioning area 110A will have a cooling air conditioning load, while the second air-conditioning area 110B will not. Likewise, if the first air-conditioning area 110A is on a sunny side of the building, while the second air-conditioning area 110B is on a shady side of the building, it is also possible of the first air-conditioning area 110A will have a cooling air conditioning load, while the second air-conditioning area 110B will not. Thus, it can be difficult to answer the simple question of whether there is a cooling air conditioning load.

One way to solve this problem is to set a threshold number of air-conditioning areas 110 for the determination of whether there is a cooling air conditioning load. If a set number of air-conditioning areas 110 have a cooling air conditioning load, then the group of air-conditioning areas 110 will be considered to have a cooling air conditioning load. Likewise, if fewer than the set number of air-conditioning areas 110 have a cooling air conditioning load, then the group of air-conditioning areas 110 will not be considered to have a cooling air conditioning load.

Furthermore, the exact determination of whether there is a cooling air conditioning load can be determined in a large number of ways, as noted above with respect to FIG. 4. One way of determining whether there is a cooling air conditioning load is to identify whether an IACU 130 is operating. If the IACU 130 operating to cool the air, then there is a cooling air conditioning load in a corresponding air-conditioning area 110; and if the IACU 130 is not operating to cool the air, then there is no cooling air conditioning load in the corresponding air-conditioning area 110.

Combining this method of estimation with the set threshold, it is possible to determine whether a group of air-conditioning areas 110 have a cooling air conditioning load by determining whether a set number of IACUs 130 are operating in a cooling mode. If the set number or more of the IACUs 130 are operating in a cooling mode, then the group of air-conditioning areas 110 can be considered to have a cooling air conditioning load. If, however, fewer than the set number of IACUs 130 are operating in a cooling mode, then the group of air-conditioning areas can be considered to not have a cooling air conditioning load.

The set threshold can set any desirable number, e.g., one IACU 130, one-third of the total IACUs 130, half of the total IACUs 130, two-thirds of the total IACUs 130, all of the total IACUs 130, or any other suitable threshold.

Figure 8:
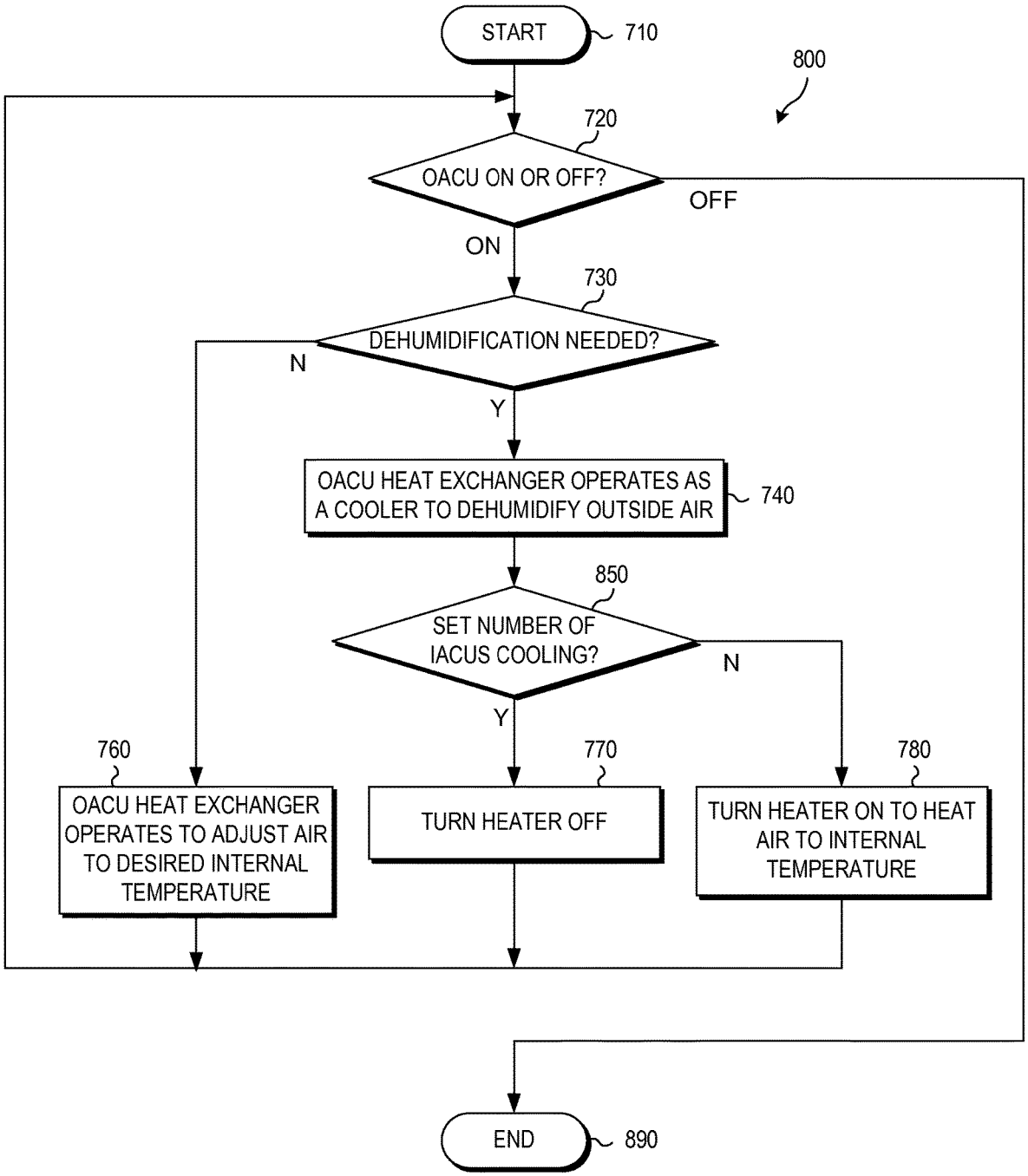
FIG. 8 is a flow chart of the operation of the air conditioning system of FIG. 1 according to another disclosed embodiment.

FIG. 8 is a flow chart of the operation of the air conditioning system of FIG. 1 according to another disclosed embodiment. FIG. 8 is identical to FIG. 10, except that the operation of determining whether a cooling air conditioning load exists (750) has been replaced with an operation of determining whether a set number of IACUs 130 are operating in a cooling mode (850).

If it is determined that the set number of IACUs 130 are operating in a cooling mode, then the controller will turn off the heater 220 in the OACU 120 for a time (770). When it does this, the OACU 120 will provide supply air to the air-conditioning space 110 at a supply temperature $T_S$ that is equal to the dehumidified temperature $T_D$. In other words, it will provide supply air that is cooler than the desired target temperature $T_T$ in an effort to overcome some of the cooling air conditioning load.

As in FIG. 7, after the heater is turned off, processing then returns to a determination of whether the OACU 120 is on or off (720).

If, however, it is determined that fewer than the set number of IACUs 130 are operating in a cooling mode, then the controller turns on the heater 220 in the OACU 120 for a time to heat the dehumidified air into supply air having a supply temperature $T_S$ that approaches a temperature sufficient to maintain desired target temperature $T_T$ (780).

As in FIG. 7, after the heater is turned off, processing then returns to a determination of whether the OACU 120 is on or off (720).

In this way, the heater 220 and the OACU 120 are operated in such a way as to minimize the operation of the IACUs 130, and thereby to minimize the total power consumption of the entire air-conditioning system 100.

Heater On and Off Times

In looping through the operations of FIGS. 7 and 8, the air-conditioning system 100 will repeatedly turn the heater 220 in the OACU 120 on and off, as required by the determination made in operation 750 or 850, i.e. whether there is a cooling air conditioning load or not, or whether a set number of IACUs 130 are operating in a cooling mode. This repetition will occur at a set determination interval, as the controller 140 repeatedly makes its determination.

Figure 9:
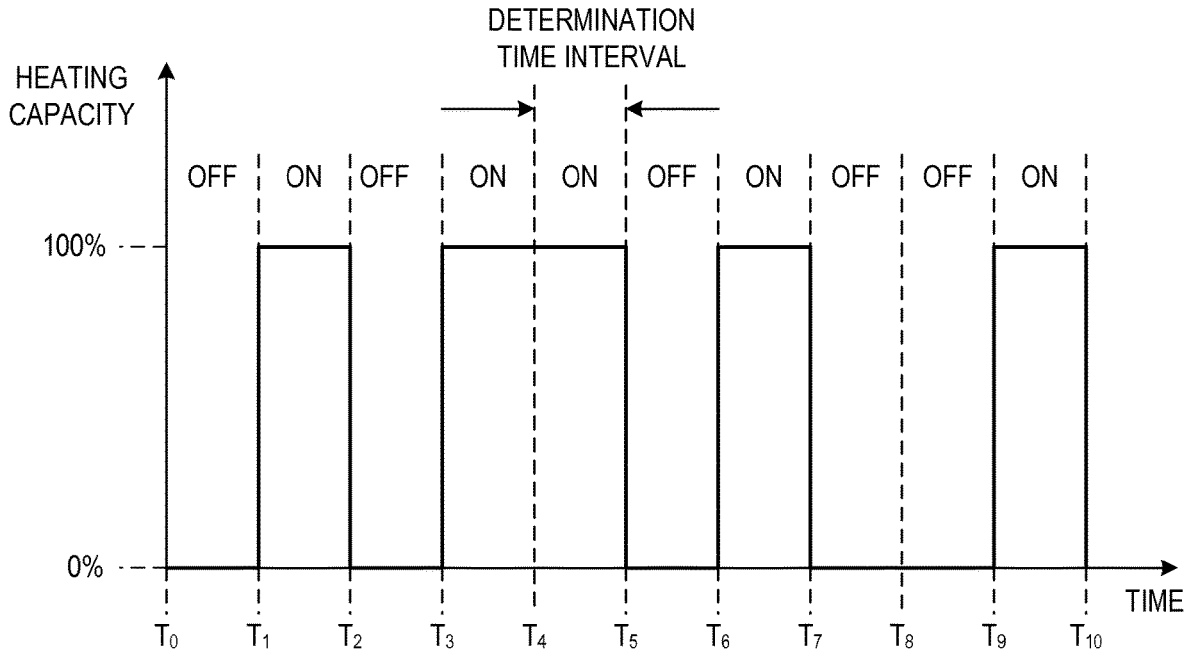
FIG. 9 is a graph of the heating capacity of the outside air conditioning unit of FIG. 1 during operation according to a disclosed embodiment.

FIG. 9 is a graph of the heating capacity of the outside air conditioning unit (OACU) 120 of FIG. 1 during operation according to a disclosed embodiment. As shown in FIG. 9, the heating capacity of the OACU 120 fluctuates between 0% and 100% as the heater 220 in the OACU 120 is turned off and on. When the heater 220 is turned off, the heating capacity of the OACU 120 is 0%. Likewise, when the heater 220 is turned on, the heating capacity of the OACU 120 is 100%.

Figure 10:
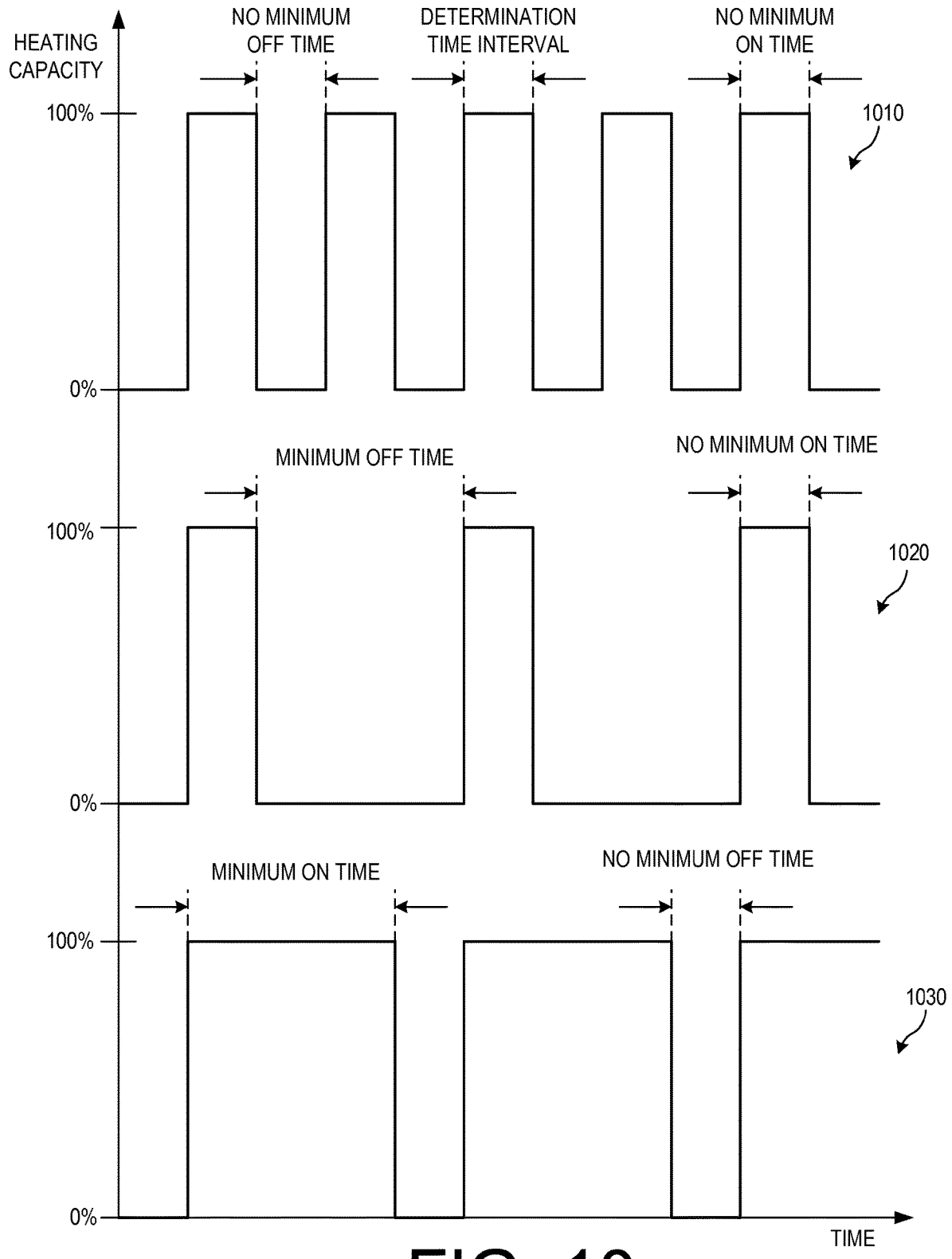
FIG. 10 is a graph of the heating capacity of the outside air conditioning unit of FIG. 1 for different operational parameters according to a disclosed embodiment.

Under basic operation, the heating capacity of the OACU 120 can potentially fluctuate between 0% and 100% every determination time interval. However, as can be seen in FIG. 10, it is also possible that the heating capacity will remain at 100% for multiple determination time intervals, or may remain at 0% for multiple determination time intervals. This potential volatility means that the heater 220 in the OACU 120 can be rapidly turned on and off, which can make control unstable.

Two ways of increasing the stability of the system are to provide a minimum on time or a minimum off time, each of which would be greater than the determination time interval. A minimum on time is the minimum time period that the heater 220 in the OACU 120 will be turned on. In other words, once the heater 220 is turned on, it must remain on at least for the minimum on time, even if the determination of the existence of a cooling air conditioning load/determination of whether a set number of OACUs 130 are operating in a cooling mode would have it turn off.

Likewise, a minimum off time is the minimum time period that the heater 220 in the OACU 120 will be turned off. In other words, once the heater 220 is turned off, it must remain off at least for the minimum off time, even if the determination of the existence of a cooling air conditioning load/determination of whether a set number of OACUs 130 are operating in a cooling mode would have it turn off.

FIG. 10 is a graph of the heating capacity of the outside air conditioning unit (OACU) 120 of FIG. 1 for different operational parameters according to a disclosed embodiment. As shown in FIG. 10, three possible situations are displayed: where there is no minimum on time or minimum off time, where there is a minimum off time, but no minimum on time, and where there is a minimum on time, but no minimum off time. In each case, the minimum on time or the minimum off time is greater than the determination time interval.

FIG. 10 shows a first graph 1010 of heating capacity over time when there is no minimum on time or minimum off time, a second graph 1020 of heating capacity over time when there is a minimum off time, but no minimum on time, and a third graph 1030 of heating capacity of a time when there is a minimum on time, but no minimum off time. In each case, these examples show the maximum amount of volatility in the system. In other words each graph shows the situation in which the heating capacity changes from 0% to 100% and back again as quickly as possible, i.e. they show the situation in which the heater 220 is turned on and off as quickly as possible.

The first graph 1010 shows that with no maximum off time or maximum on time, the heating capacity of the OACU 120 can flip from 0% to 100% and back again every determination time interval. In other words, the heater 220 can be turned on and off every determination time interval. As noted above, this volatility can make control of the system unstable.

The second graph 1020 shows that with a minimum off time, but no minimum on time, the OACU 120 must maintain a 0% heating capacity for at least the minimum off time before it flips to 100% again. However, it can flip back from 100% heating capacity to 0% heating capacity after only a single determination time interval. In other words, once it is turned off, the heater 220 must remain off for the minimum off time before it can be turned on. However, the heater 220 can be turned off after it has been on for only the determination time interval.

This solution will improve the stability of the system, but at the cost of heating capacity. Since the heating capacity must be maintained at 0% for at least the minimum off time, the heater 220 may remain off at times when it should otherwise be on. This can cause the air-conditioning areas 110 associated with the OACU 120 to be colder than they should be based on their desired target temperatures $T_T$.

The third graph 1030 shows that with a minimum on time, but no minimum off time, the OACU 120 must maintain a 100% heating capacity for at least the minimum on time before it flips to 0% again. However, it can flip back from 0% heating capacity to 100% heating capacity after only a single determination time interval. In other words once it is turned on, the heater 220 must remain on for the minimum on time before it can be turned off. However, the heater 220 can be turned on after it has been off for only a single determination time interval.

As with the solution shown in the second graph 1020, the solution shown in the third graph 1030 will improve the stability of the system. However it does so without a loss of heating capacity. Since the heating capacity in this example need only stay at 0% for a single determination time interval, it is easier to raise the heating capacity than to lower it. In other words, the maximum amount of time that the heater 220 may remain off is one determination time interval. This means that there should be no times when the system would want the heating capacity of the OACU 120 to be 100%, i.e., when it would want the heater 220 to be on, and it would be unable to do so. As a result, this solution can both provide stability and maintain the air-conditioning areas 110 associated with the OACU 120 at a comfortable temperature.

It should be noted of course that FIG. 10 shows the worst case in which the heating capacity of the OACU is flipped from 0% to 100% as quickly as possible. In practice, the heating capacity may be maintained at 100%, or maintained at 0%, for much longer periods of time.

In addition, although not discussed above, it is also possible to have a configuration in which both a minimum on time and a minimum off time are employed. In such a configuration, a heater in the OACU 120 could only be turned off if it has been on for the minimum on time. Similarly, the heater could only be turned on if it has been off for the minimum off time.

Figure 11:
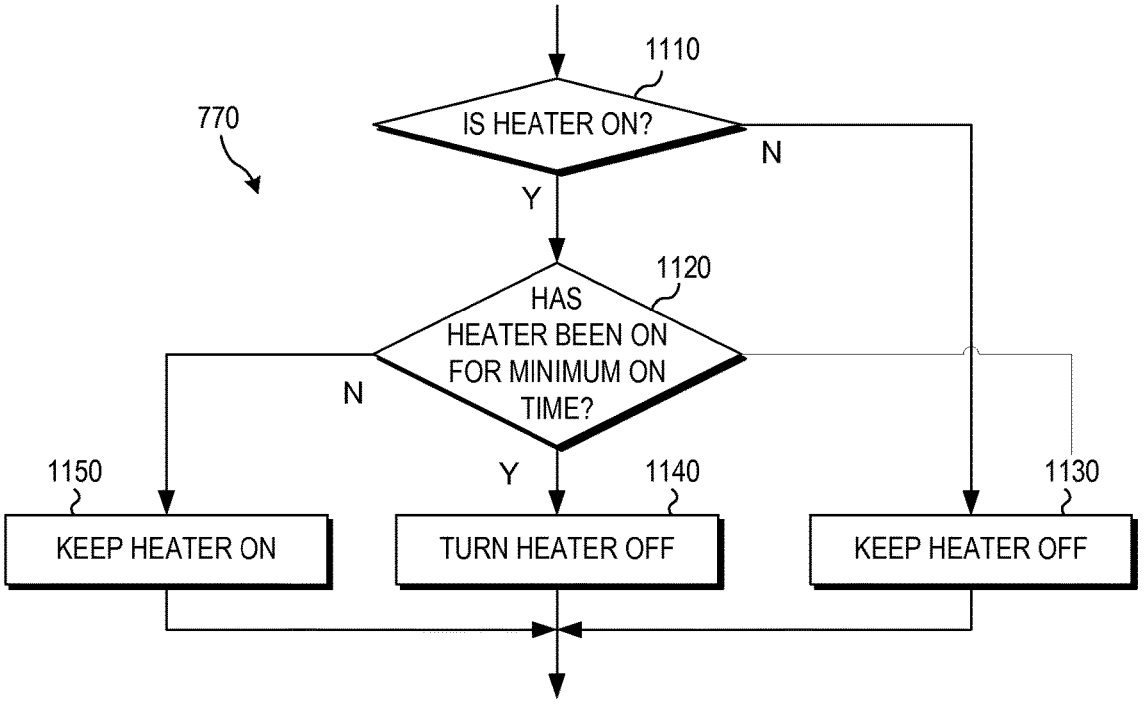
FIG. 11 is a flow chart showing the operation of turning a heater off from FIGS. 7 and 8 according to a disclosed embodiment.

FIG. 11 is a flow chart showing the operation of turning a heater off (770) from FIGS. 7 and 8 according to a disclosed embodiment. In particular, this embodiment employs a minimum on time. As a result, operation 770 is more properly a determination of whether to turn the heater off when instructed to, and the actions taken based on that determination.

As shown in FIG. 11, in this embodiment, operation 770 starts by determining whether the heater 220 is currently on (1110). If the heater is not currently on, i.e. it is off, the controller keeps the heater off (1130) and returns back to the operation of determining whether the OACU is on or off (720).

If the heater 220 is currently on, then the controller determines whether or not the heater has been on for the minimum on time (1120). If the heater has been on for the minimum on time, then the controller turns the heater off (1140), and returns back to the operation of determining whether the OACU is on or off (720).

If the heater has not been on for the minimum on time, then the controller keeps the heater on (1150) despite the fact that it should otherwise be turned off, and returns back to the operation of determining whether the OACU is on or off (720). By doing this, the controller prevents the heater from being turned on and off too quickly. Furthermore, it does so in a way that errs on the side of keeping the heater on rather than keeping the heater off. This helps better maintain the associated air-conditioning area 110 at a comfortable temperature.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed is:

1. A method of controlling an outdoor air conditioner formed outside of a structure, the method comprising:

drawing outdoor air into the outdoor air conditioner;

cooling the outdoor air to a dehumidification temperature to provide dehumidified air in the outdoor air conditioner;

determining whether an air conditioning load exists in an air conditioning space inside the structure based on one of: an amount of sunlight incident on a structure containing the air conditioning space or an operating status of the indoor air conditioner;

heating the dehumidified air in the outdoor air conditioner to generate supply air if it is determined that no air conditioning load exists in the air conditioning space;

passing the dehumidified air at the dehumidification temperature as the supply air if it is determined that an air conditioning load exists in the air conditioning space; and providing the supply air from the outdoor air conditioner to the air conditioning space without passing through an indoor air conditioner.

2. The method of claim 1, wherein a minimum on time is a minimum amount of time that the dehumidified air can be heated, a minimum off time is a minimum amount of time that the dehumidified air can be passed as supply air without being heated, and the minimum on time is greater than the minimum off time.

3. The method of claim 1, further comprising:

determining whether the dehumidified air is currently being heated;

determining whether the dehumidified air has been heated for a minimum on time if it is determined that the dehumidified air is currently being heated, heating the dehumidified air to generate supply air if it is determined that the set number of the plurality of indoor air conditioners are not operating in the cooling mode, or if the dehumidified air is currently being heating, but has not been heating for at least the minimum on time; and passing the dehumidified air at the dehumidification temperature as the supply air if it is determined that all of the plurality of indoor air conditioners are operating in the cooling mode, and that either the dehumidified air is not currently being heated or that the dehumidified air has been heated for a minimum on time, wherein the minimum on time is a minimum amount of time that the dehumidified air can be heated, a minimum off time is a minimum amount of time that the dehumidified air can be passed as supply air without being heated, and the minimum on time is greater than the minimum off time.

4. An air conditioning system, comprising:

an outdoor air conditioner provided outside a structure, including an outdoor heat-exchanger, an outdoor heater, and an outdoor blower configured to draw outside air through the outdoor heat-exchanger and the outdoor heater to generate supply air, and to provide the supply air to an air conditioning space inside the structure;

an indoor air conditioner provided inside the air conditioning space, including an indoor heat-exchanger, and an indoor blower configured to draw indoor air through the indoor heat-exchanger to generate conditioned indoor air, and to provide the conditioned indoor air to the air conditioning space;

a control circuit configured to determine whether an air conditioning load exists in the air conditioning space, and to selectively turn on the outdoor heater based on whether the air conditioning load is determined to exist in the air conditioning space; and a load detector configured to identify an air conditioning load in the air conditioning space based on one of an amount of sunlight incident on a structure containing the air conditioning space or an operating status of the indoor air conditioner.

5. The air conditioning system of claim 4, wherein the control circuit further comprises an indoor air conditioner operation sensor configured to determine whether the indoor air conditioner is currently operating, and the air conditioning load exists if the indoor air conditioner operation sensor determines that the indoor air conditioner is currently operating in cooling mode.

6. The air conditioning system of claim 4, wherein the control circuit further comprises a solar radiation sensor configured to detect an amount of solar radiation incident on the air conditioning space, the air conditioning load exists if the detected amount of solar radiation exceeds a solar radiation threshold.

7. The air conditioning system of claim 4, wherein the control circuit further comprises an indoor temperature sensor configured to detect an indoor temperature in the air conditioning space, the air conditioning load exists if the detected indoor temperature exceeds an indoor temperature threshold.

8. The air conditioning system of claim 4, wherein the control circuit further comprises an air conditioning space population sensor configured to detect a number of people in the room.

9. The air conditioning system of claim 4, wherein the control circuit further comprises an energy consumption sensor configured to detect an energy consumption of the air conditioning system, the air conditioning load exists if the detected energy consumption exceeds an energy consumption threshold.

10. The air conditioning system of claim 4, wherein the control circuit further comprises a clock configured to determine a current time of day, the air conditioning load exists if the current time of day falls within a set time range.

11. The air conditioning system of claim 4, wherein the control circuit further comprises a calendar circuit configured to determine a current date, the air conditioning load exists if the current date falls within a set date range.

12. The air conditioning system of claim 4, wherein the control circuit further comprises an outside temperature sensor configured to detect the outside temperature, the air conditioning load exists if the outside temperature is above a temperature threshold.

13. The air conditioning system of claim 4, wherein the control circuit further comprises an indoor temperature sensor configured to detect an indoor temperature in the room, and a supply air temperature sensor configured to detect a supply air temperature of the supply air, and the air conditioning load exists if the supply air temperature is lower than the indoor temperature.

14. A method of controlling an outdoor air conditioner formed outside of a structure, the method comprising:

drawing outdoor air into the outdoor air conditioner;

cooling the outdoor air to a dehumidification temperature to provide dehumidified air in the outdoor air conditioner;

determining whether a set number of a plurality of indoor air conditioners associated in the structure, respectively, are operating in a cooling mode;

heating the dehumidified air in the outdoor air conditioner to generate supply air if it is determined that the set number of the plurality of indoor air conditioners are not operating in the cooling mode;

passing the dehumidified air at the dehumidification temperature as the supply air if it is determined that all of the plurality of indoor air conditioners are operating in the cooling mode; and providing the supply air from the outdoor air conditioner to the plurality of air conditioning spaces without passing through any of the plurality of indoor air conditioners.

15. The method of claim 14, further comprising:

continually repeating the operations of drawing outside air, cooling the outside air, determining whether the plurality of indoor air conditioners are operating, passing the dehumidified air as the supply air if it is determined that the set number of the plurality of indoor air conditioners are operating in the cooling mode, and providing the supply air to the air conditioning space.

16. The method of claim 14, wherein the set number of the plurality of indoor air conditioners is all of the plurality of indoor air conditioners.

17. The method of claim 14, further comprising:

determining whether the plurality of indoor air conditioners are operating, heating the dehumidified air if it is determined that the set number of the plurality of indoor air conditioners are not operating in the cooling mode.

18. The method of claim 14, further comprising:

heating the dehumidified air if it is determined that one of the plurality of indoor air conditioners are operating in the heating mode.

19. The method of claim 14, wherein a minimum on time is a minimum amount of time that the dehumidified air can be heated, a minimum off time is a minimum amount of time that the dehumidified air can be passed as supply air without being heated, and the minimum on time is greater than the minimum off time.

20. The method of claim 14, further comprising:

determining whether the dehumidified air is currently being heated;

determining whether the dehumidified air has been heated for a minimum on time if it is determined that the dehumidified air is currently being heated, heating the dehumidified air to generate supply air if it is determined that the set number of the plurality of indoor air conditioners are not operating in the cooling mode, or if the dehumidified air is currently being heating, but has not been heating for at least the minimum on time; and passing the dehumidified air at the dehumidification temperature as the supply air if it is determined that all of the plurality of indoor air conditioners are operating in the cooling mode, and that either the dehumidified air is not currently being heated or that the dehumidified air has been heated for a minimum on time, wherein the minimum on time is a minimum amount of time that the dehumidified air can be heated, a minimum off time is a minimum amount of time that the dehumidified air can be passed as supply air without being heated, and the minimum on time is greater than the minimum off time.

21. The air conditioning system of claim 4, further comprising:

a second indoor air conditioner provided inside a second air conditioning space, including a second indoor heat-exchanger, and a second indoor blower configured to draw indoor air through the second indoor heat-exchanger to generate second conditioned indoor air, and to provide the second conditioned indoor air to the second air conditioning space.

* * * * *